US008113153B2

(12) United States Patent
Holt et al.

(10) Patent No.: US 8,113,153 B2
(45) Date of Patent: Feb. 14, 2012

(54) RETURN TEMPERATURE STABILIZER ASSEMBLY

(75) Inventors: Clifford Holt, Westfield, MA (US); Thomas Neill, Southampton, MA (US)

(73) Assignee: Mestek, Inc., Westfield, MA (US)

( * ) Notice: Subject to any disclaimer, the term of this patent is extended or adjusted under 35 U.S.C. 154(b) by 711 days.

(21) Appl. No.: 12/170,851

(22) Filed: Jul. 10, 2008

(65) Prior Publication Data

US 2009/0025656 A1 Jan. 29, 2009

Related U.S. Application Data

(60) Provisional application No. 60/951,487, filed on Jul. 24, 2007.

(51) Int. Cl.
*F22B 25/00* (2006.01)

(52) U.S. Cl. ..... 122/19.1; 122/235.31; 122/235.16

(58) Field of Classification Search ..... 122/19.1, 122/19.2, 37, 75, 77, 235.16, 235, 31
See application file for complete search history.

(56) References Cited

U.S. PATENT DOCUMENTS

| | | | | |
|---|---|---|---|---|
| 2,593,946 | A * | 4/1952 | Weldy | 122/54 |
| 2,833,273 | A * | 5/1958 | Miller | 122/14.3 |
| 2,845,905 | A | 8/1958 | Smith | |
| 3,705,574 | A * | 12/1972 | Duncan | 122/14.2 |
| 3,958,555 | A * | 5/1976 | Horne | 122/13.3 |
| 4,344,479 | A | 8/1982 | Bailey | |
| 4,646,637 | A | 3/1987 | Cloots | |
| 4,750,472 | A * | 6/1988 | Fazekas | 122/13.3 |
| 5,555,850 | A * | 9/1996 | Garcia | 122/248 |
| 5,676,805 | A * | 10/1997 | Silveri | 204/212 |
| 5,713,311 | A * | 2/1998 | Fitzgerald | 122/406.5 |
| 5,752,282 | A * | 5/1998 | Silveri | 4/541.1 |
| 5,890,458 | A | 4/1999 | Kim | |
| 6,684,823 | B1 | 2/2004 | Plavnik et al. | |
| 7,036,462 | B2 | 5/2006 | Cohen | |
| 7,773,868 | B2 * | 8/2010 | Moore | 392/490 |

FOREIGN PATENT DOCUMENTS

| | | |
|---|---|---|
| CA | 2431330 A1 | 7/2002 |
| GB | 0641597 | 8/1950 |

* cited by examiner

*Primary Examiner* — Gregory A Wilson

(74) *Attorney, Agent, or Firm* — McCormick, Paulding & Huber LLP

(57) ABSTRACT

A return temperature stabilizer assembly or metering means is provided for a boiler that facilitates the mixing of cooler, inlet return fluid with the heated fluid within the boiler chamber whereby the temperature striations within the boiler chamber are reduced or eliminated, and wherein the temperature stabilizer assembly is modular in design, and therefore capable of easily accommodating boilers of differing sizes.

18 Claims, 3 Drawing Sheets

RETURN TEMPERATURE STABILIZER ASSEMBLY

CROSS REFERENCE TO RELATED APPLICATIONS

This application claims the benefit of U.S. Provisional Application Ser. No. 60/951,487, filed on Jul. 24, 2007, herein incorporated by reference in its entirety.

FIELD OF THE INVENTION

This invention relates, in general, to a return temperature stabilizer assembly, and deals more particularly with a modular return temperature stabilizer assembly or metering means for a boiler unit.

BACKGROUND OF THE INVENTION

Boilers, either commercial or residential, are typically utilized in order to bring a circulating fluid to a desired temperature. The employed fluid is typically water, and the heated water may be provided for cooking or washing, as well as being circulated to provide radiant heat to an enclosure, such as a house or commercial building.

Boilers may be either top-fired, or bottom-fired, in dependence upon whether the burner unit is disposed in the upper or lower portions, respectively, of the boiler housing. Regardless of the orientation of the burner, it is often the case that the water within the boiler chamber will have certain temperature striations therein.

These temperature striations are often caused by the inlet flow of fluid into the boiler chamber, where the inlet flow is typically much lower in temperature by the time it is circulated and returned to the boiler.

It is of course preferable to have the water within the boiler be as uniform in temperature as possible, both for purposes of energy efficiency, as well as to prevent any thermal shock to the boiler itself.

With the forgoing problems and concerns in mind, it is the general object of the present invention to provide a boiler having a return temperature stabilizer assembly, for facilitating the mixing of inlet return water, with heated water within the boiler chamber.

SUMMARY OF THE INVENTION

It is an object of the present invention to provide a return temperature stabilizer assembly.

It is another object of the present invention to provide a return temperature stabilizer assembly or metering means for a boiler.

It is another object of the present invention to provide a return temperature stabilizer assembly or metering means for a boiler that facilitates the mixing of cooler, inlet return water with the heated water within the boiler chamber.

It is another object of the present invention to provide a return temperature stabilizer assembly or metering means for a boiler in which the temperature striations within the boiler chamber are reduced or eliminated.

It is another object of the present invention to provide a return temperature stabilizer assembly or metering means for a boiler, which is modular in design, and therefore capable of easily accommodating boilers of differing sizes.

These and other objectives of the present invention, and their preferred embodiments, shall become clear by consideration of the specification, claims and drawings taken as a whole.

DETAILED DESCRIPTION OF THE PREFERRED EMBODIMENT

Figure 1:
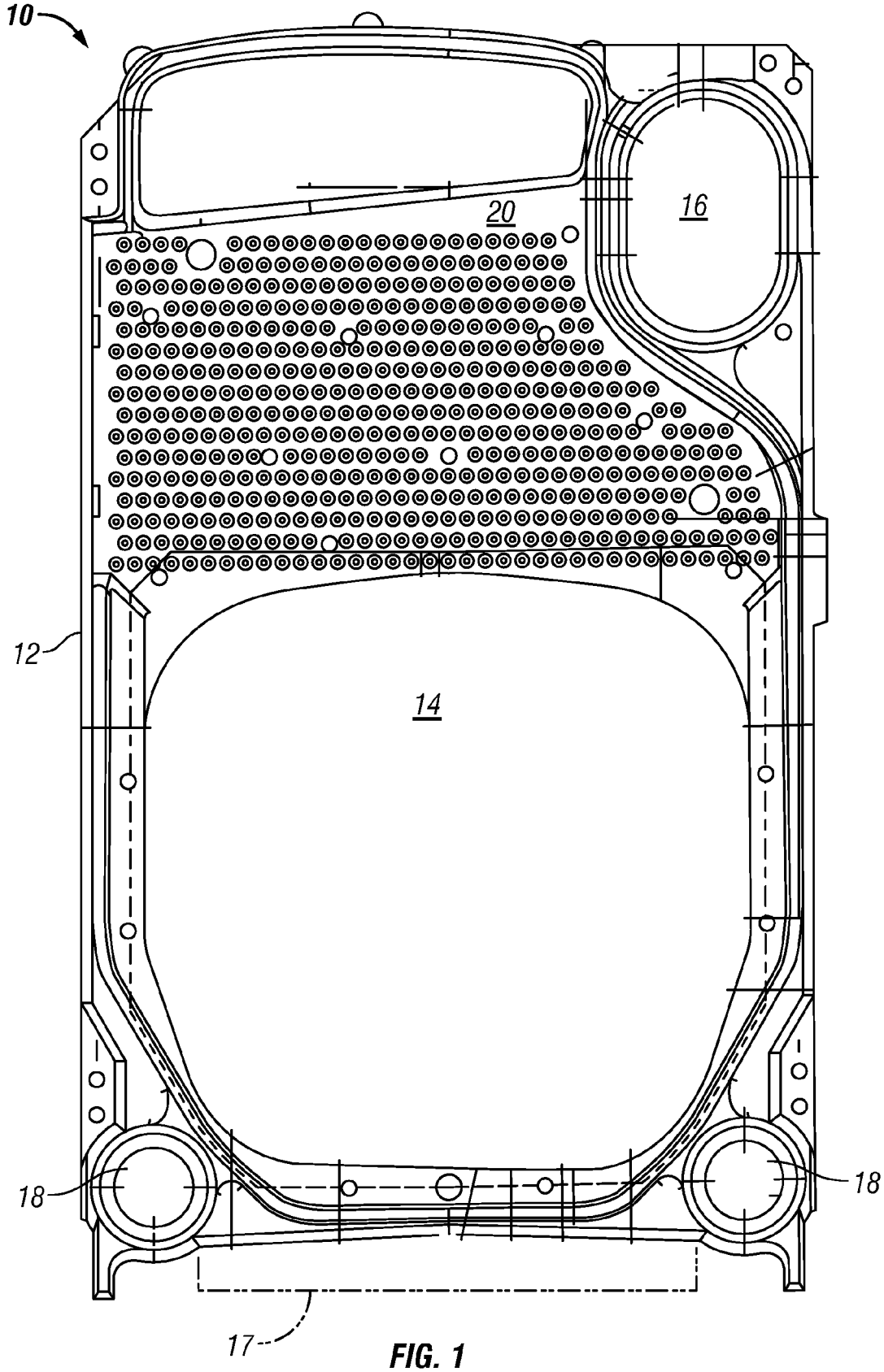
FIG. 1 is a cross-sectional view of a bottom-fired boiler, in accordance with one embodiment of the present invention.

FIG. 1 is a cross-sectional view of a bottom-fired boiler 10. As shown in FIG. 1, the boiler 10 includes a boiler housing 12, an internal boiler chamber 14 and an oblong inlet return port 16.

A burner element 17 is disposed beneath the body of the boiler chamber 14 and is operated in a known fashion in order to provide heat to the fluid (water) within the boiler chamber 14. Drain ports 18 may be selectively utilized to enable the draining of the boiler chamber 14, or the like.

As will be appreciated, boiler fluid (i.e., water) is provided to and disposed within the boiler chamber 14 and is heated by the activity of the burner element, 17 as is well known. The burner element typically heats the water within the boiler chamber 14 until a predetermined water temperature is obtained. During this heating process, the water typically circulates about and around the boiler chamber 14 through natural convection, with the warmer water raising to the upper portion 20 of the boiler chamber 14.

It is therefore an important aspect of the present invention that cooler, return inlet water is directed to the oblong inlet return port 16, which is in fluid communication with the boiler chamber 14. In doing so, the present invention seeks to provide the time and turbulence needed to mix the warmer water within the upper portion 20, with the cooler, return inlet water, as will be described in more detail shortly.

Figure 2:
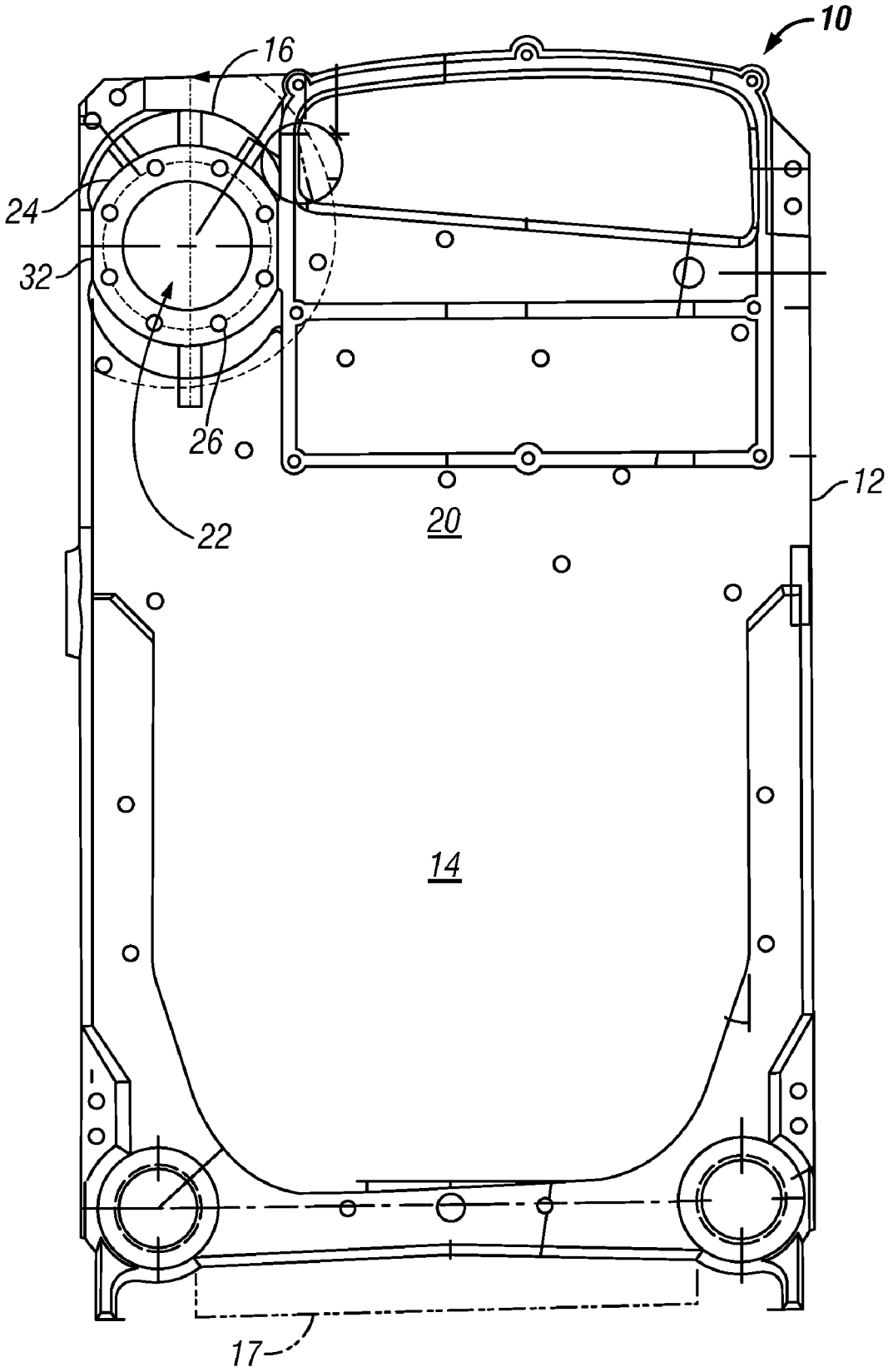
FIG. 2 is a reverse cross-section view of the boiler shown in FIG. 1.
Figure 3:
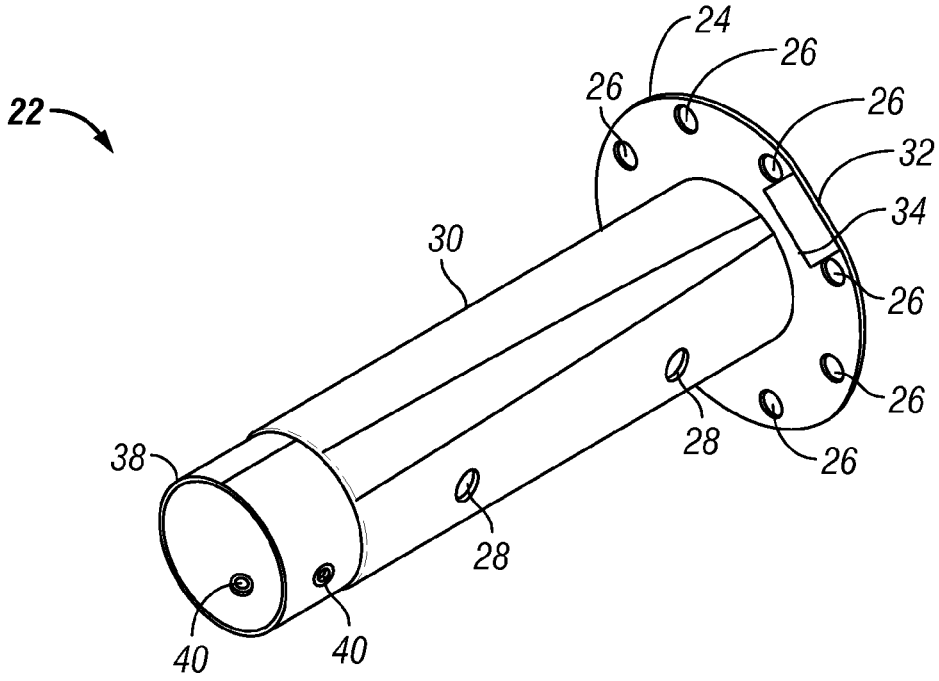
FIG. 3 is a perspective view of a return temperature stabilizer assembly, or metering means, in accordance with one embodiment of the present invention.

FIG. 2 is a reverse cross-section view of the boiler 10, in which it can be seen that a flanged, return temperature stabilizer, or metering means 22, is fixed within the oblong inlet return port 16. FIG. 3 illustrates a perspective view of the return temperature stabilizer, or metering means 22, while FIG. 4 illustrates a cross-sectional view of the return temperature stabilizer, or metering means 22.

Figure 4:
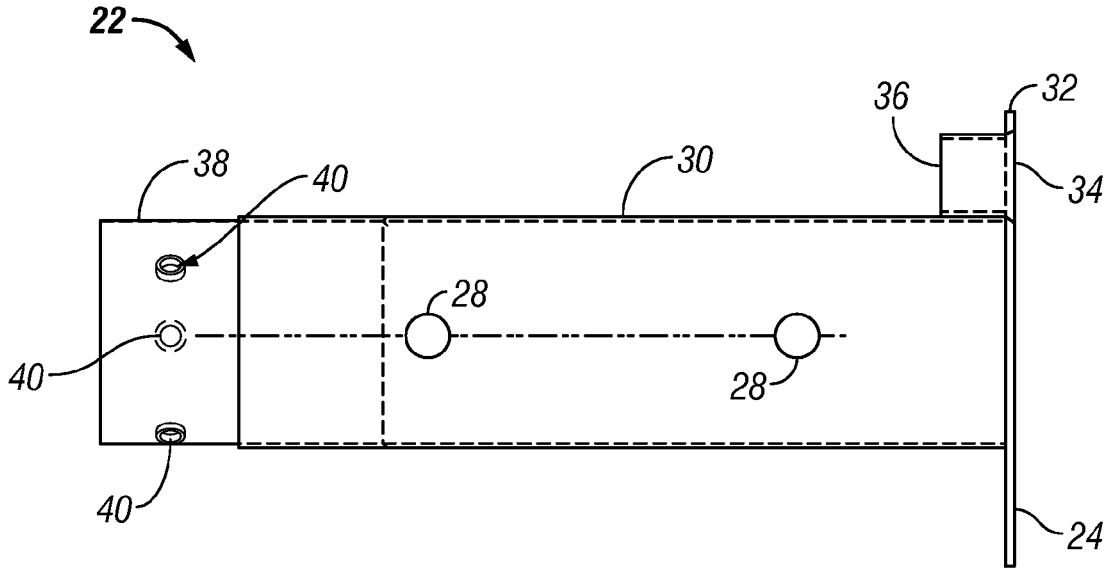
FIG. 4 is a cross-sectional view of the return temperature stabilizer assembly, or metering means, of FIG. 3.

As can be seen from FIGS. 3 and 4, the return temperature stabilizer assembly 22 includes a flange portion 24 having a plurality of securing apertures 26 formed about the periphery thereof. The flange 24 and the securing apertures 26 are utilized to mount the return temperature stabilizer assembly 22 within the oblong return port 16 (as shown in FIG. 2).

A plurality of mixing apertures 28 are formed in a tube portion 30 of the return temperature stabilizer assembly 22. While two mixing apertures 28 are shown in FIGS. 3 and 4, it will readily be appreciated that any number of mixing apertures 28 may be formed in the tube portion 30, depending upon the amount of mixing desired, without departing from the broader aspects of the present invention.

Returning now to FIG. 2, the return temperature stabilizer assembly 22 is fixed within the return port 16 (to the boiler housing 12 or the like) via the securing apertures 26. In order to assist the correct positioning of the return temperature stabilizer assembly 22 therein, the flange portion 24 includes a flattened portion 32, which is best seen in FIG. 3. The flange portion 24 may also define a locating pass-through 34 in the general region of the flattened portion 32. A structural hub 36 (best shown in FIG. 4) may also be defined within the return port 16, and is sized to be accommodated within the pass-through 34.

It will therefore be readily appreciated that the return temperature stabilizer assembly 22 may utilize the pass-through 34 and the hub 36 to properly position the flange 24, and indeed the entire return temperature stabilizer assembly 22, within the oblong return port 16. It will further be appreciated that the return temperature stabilizer assembly 22 may be fixed within the oblong return port 16 via another means, apart from having a flattened portion 32 or utilizing the pass-through 34 and hub 36, without departing from the broader aspects of the present invention.

As shown in FIGS. 3 and 4, the return temperature stabilizer assembly 22 also defines a distal end 38, preferably having a slightly smaller diameter than the diameter of the tube portion 30. The distal end 38 includes a plurality of extension holes 40 which are utilized to join successive section of the tube portion 30 to one another, thereby lengthening the return temperature stabilizer assembly 22 to accommodate boilers of various dimensions.

As will be appreciated, the boiler 10 shown in FIGS. 1 and 2 may be of any predetermined width, in dependence upon the heating capacity needed. Thus, it is necessary that the return temperature stabilizer assembly 22 be modular in design, so as to accommodate boilers of various widths. In the present case, and as illustrated in FIGS. 3 and 4, the distal end 38 of the tube portion 30 is designed to slip within another tube portion 30 (preferably without another, or second, flange 24). By doing so, and by utilizing the extension holes 40 to fasten the distal end 38 to another tube portion 30 (having matching extension holes formed therein), the present invention enables the return temperature stabilizer assembly 22 to extend to any desired length, thus accommodating a boiler, and return port 16, of any size/length.

In operation, the present invention directs cooler, return water back to the boiler 10, via the return temperature stabilizer assembly 22. Thus, instead of delivering the cooler, return water to the bottom of the boiler chamber 14, the return water is directed to the upper portion 20 via the return port 16, which is in fluid communication with the upper portion 20 and, therefore, the boiler chamber 14 as a whole.

It is therefore an important aspect of the present invention that directing the cooler, return water to the upper portion 20 of the boiler 10 will cause a more complete mixing of this cooler water with the heated water that has migrated to the upper portion 20 of the boiler chamber 14. Thus, temperature striations within the boiler chamber 14 can be advantageously reduced.

It is another important aspect of the present invention that the cooler, return water is not simply dumped into the return port 16 in an unregulated manner, but is instead metered into the return port 16 via the mixing holes 28 formed in the tube portion 30. That is, by forming the mixing apertures 28 in the tube portion 30, the present invention ensures that the cooler, return water within the return temperature stabilizer assembly 22 is more carefully presented to the surrounding warmer water of the return port 16. In this fashion, the cooler, return water will not 'overwhelm' the warmer water circulating between the return port 16 and the upper portion 20 of the boiler chamber 14, thus preventing the creation of any new temperature striations therein.

The mixing apertures 28, as well as the oblong profile of the return port 16, provide yet another attribute to the present invention. That is, the cooler, return water coursing through the return temperature stabilizer 22 must exit the tube portion 30 via the spaced-apart mixing apertures 28, and will therefore do so as orthogonal-moving jets of higher pressure and velocity. As these jets exit the tube portion 30 and impact the walls of the oblong return port 16, the turbulence created thereby increases the rate and extent of the mixing within the return port 16, and therefore increases the ability of the present invention to harmonize the temperature striations within the boiler chamber 14 as a whole.

Thus, by the time the burner element of the boiler 10 'sees' the cooler, return water, the return water has already mixed at the upper portion 20 of the boiler chamber 14. Such a regimen, when coupled with the inherent convection of the boiler, substantially eliminates temperature striations throughout the boiler chamber, while also protecting the boiler from thermal shock.

While the present invention has been described in connection with a bottom-fired boiler, it will be readily appreciated that a similar return temperature stabilizer 22 may also be utilized in a top-fired boiler, taking into account the different structure thereof, without departing from the broader aspects of the present invention.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A boiler having a boiler chamber within which a fluid is heated by a burner element, said boiler being supplied with previously circulated fluid, said boiler comprising: a housing having an inlet return port formed therein, said inlet return port being in fluid communication with said boiler chamber; and a metering means for providing controlled turbulence to thoroughly mix said fluid in said boiler chamber with said previously circulated fluid; and wherein said inlet return port directs said previously circulated fluid to an upper portion of said boiler chamber for complete mixing with said fluid in said boiler chamber.

2. A boiler according to claim 1, wherein said metering means is modular in design for accommodating boilers of differing sizes.

3. A boiler according to claim 1, wherein said metering means includes a tubular portion having a distal end of reduced diameter, said distal end having extension openings therein for joining successive sections of tubular portions to one another.

4. A boiler according to claim 1, wherein said burner element is disposed below said boiler chamber.

5. A boiler according to claim 1, wherein said burner element is disposed above said boiler chamber.

6. A boiler having a boiler chamber within which a fluid is heated by a burner element, said boiler being supplied with previously circulated fluid, said boiler comprising: a housing having an inlet return port formed therein, said inlet return port being in fluid communication with said boiler chamber; and a metering means for providing controlled turbulence to thoroughly mix said fluid in said boiler chamber with said previously circulated fluid; and wherein said metering means is disposed in said inlet return port and comprises a tube having apertures therein for passage of said previously circulated fluid therethrough whereby said previously circulated fluid does not 'overwhelm' said fluid in said boiler chamber thereby preventing the creation of new temperature striations therein.

7. A boiler having a boiler chamber within which a fluid is heated by a burner element, said boiler being supplied with previously circulated fluid, said boiler comprising: a housing having an inlet return port formed therein, said inlet return port being in fluid communication with said boiler chamber; and a metering means for providing controlled turbulence to thoroughly mix said fluid in said boiler chamber with said previously circulated fluid; and wherein said inlet return port is oblong in profile and said metering means includes a tubular portion having spaced-apart mixing apertures for the exit of said previously circulated fluid as orthogonal moving jets of higher pressure and velocity which impact the walls of said inlet return port whereby the turbulence created thereby increases the rate and mixing within said inlet return port to harmonize the temperature striations within said boiler chamber.

8. A boiler having a boiler chamber within which a fluid is heated by a burner element, said boiler being supplied with previously circulated fluid, said boiler comprising: a housing having an inlet return port formed therein, said inlet return port being in fluid communication with said boiler chamber; and a metering means for providing controlled turbulence to thoroughly mix said fluid in said boiler chamber with said previously circulated fluid; and wherein said inlet return port is oblong in profile and said metering means includes a tubular portion disposed within said inlet port and mounted thereto by a flange portion, and locating means on said flange portion cooperating with locating means on said inlet return port for properly positioning said metering means within said inlet return port.

9. A boiler having a boiler chamber within which a fluid is heated by a burner element, said boiler being supplied with previously circulated fluid, said boiler comprising: a housing having an inlet return port formed therein, said inlet return port being in fluid communication with said boiler chamber; and a metering means for providing controlled turbulence to thoroughly mix said fluid in said boiler chamber with said previously circulated fluid; and wherein said metering means includes a tubular portion having means for joining successive tubular portions thereto for increasing its length to accommodate boilers of various dimensions.

10. A return temperature stabilizer assembly for a boiler wherein fluid disposed within a boiler chamber is heated by a burner element, circulated within a mixing chamber and mixed with cooler inlet fluid, said return temperature stabilizer assembly being disposed in an inlet return port in fluid communication with said boiler chamber, said temperature stabilizer assembly including metering means for providing controlled turbulence to thoroughly mix said fluid in said boiler chamber with said cooler inlet fluid while reducing temperature striations; and wherein said inlet return port directs said cooler inlet fluid to an upper portion of said mixing chamber for complete mixing with said fluid in said mixing chamber.

11. A return temperature stabilizer assembly according to claim 10, wherein said metering means is modular in design for accommodating boilers of differing sizes.

12. A return temperature stabilizer assembly according to claim 10, wherein said burner element is disposed below said boiler chamber.

13. A return temperature stabilizer assembly according to claim 10, wherein said burner element is disposed above said boiler chamber.

14. A return temperature stabilizer assembly for a boiler wherein fluid disposed within a boiler chamber is heated by a burner element, circulated within a mixing chamber and mixed with cooler inlet fluid, said return temperature stabilizer assembly being disposed in an inlet return port in fluid communication with said boiler chamber, said temperature stabilizer assembly including metering means for providing controlled turbulence to thoroughly mix said fluid in said boiler chamber with said cooler inlet fluid while reducing temperature striations; and wherein said metering means comprises a tube having apertures therein for passage of said cooler inlet fluid therethrough whereby said cooler inlet fluid does not 'overwhelm' said fluid in said boiler chamber thereby preventing the creation of new temperature striations therein.

15. A return temperature stabilizer assembly for a boiler wherein fluid disposed within a boiler chamber is heated by a burner element, circulated within a mixing chamber and mixed with cooler inlet fluid, said return temperature stabilizer assembly being disposed in an inlet return port in fluid communication with said boiler chamber, said temperature stabilizer assembly including metering means for providing controlled turbulence to thoroughly mix said fluid in said boiler chamber with said cooler inlet fluid while reducing temperature striations; and wherein said inlet return port is oblong and said metering means includes a tubular portion having spaced-apart mixing apertures for the exit therethrough of said cooler return fluid as orthogonal moving jets of higher pressure and velocity which impact the walls of said inlet return port whereby the turbulence created thereby increases the rate and mixing within said inlet return port to harmonize the temperature striations within said boiler chamber.

16. A return temperature stabilizer assembly for a boiler wherein fluid disposed within a boiler chamber is heated by a burner element, circulated within a mixing chamber and mixed with cooler inlet fluid, said return temperature stabilizer assembly being disposed in an inlet return port in fluid communication with said boiler chamber, said temperature stabilizer assembly including metering means for providing controlled turbulence to thoroughly mix said fluid in said boiler chamber with said cooler inlet fluid while reducing temperature striations; and wherein said inlet return port is oblong in profile and said metering means includes a tubular portion disposed within said inlet port and mounted thereto by a flange portion, and locating means on said flange portion cooperating with locating means on said inlet return port for properly positioning said metering means within said inlet return port.

17. A return temperature stabilizer assembly for a boiler wherein fluid disposed within a boiler chamber is heated by a burner element, circulated within a mixing chamber and mixed with cooler inlet fluid, said return temperature stabilizer assembly being disposed in an inlet return port in fluid communication with said boiler chamber, said temperature stabilizer assembly including metering means for providing controlled turbulence to thoroughly mix said fluid in said boiler chamber with said cooler inlet fluid while reducing temperature striations; and wherein said metering means includes a tubular portion having means for joining successive tubular portions thereto for increasing its length to accommodate boilers of various dimensions.

18. A method of mixing cool inlet return fluid with heated fluid within a boiler chamber comprising, positioning a temperature stabilizer assembly in an inlet return port of oblong profile in fluid communication with the boiler chamber and providing metering means within the temperature stabilizer assembly comprising a tubular portion having apertures for the exit of cool inlet fluid therethrough for impacting the walls of the return port for creating turbulence while increasing the rate and mixing of the fluids within the return port to harmonize the temperature striations within the boiler.

* * * * *